US006783218B2

(12) United States Patent
Cheok

(10) Patent No.: US 6,783,218 B2
(45) Date of Patent: Aug. 31, 2004

(54) INK TANK (INKJET INK CARTRIDGE)

(75) Inventor: Tan Kong Cheok, Singapore (SG)

(73) Assignee: Inke Pte. Ltd., Jurong (SG)

( * ) Notice: Subject to any disclaimer, the term of this patent is extended or adjusted under 35 U.S.C. 154(b) by 0 days.

(21) Appl. No.: 10/292,195

(22) Filed: Nov. 11, 2002

(65) Prior Publication Data

US 2004/0046843 A1 Mar. 11, 2004

(51) Int. Cl.[7] ..... B41J 2/175
(52) U.S. Cl. ..... 347/86
(58) Field of Search ..... 347/85, 86, 36; 141/198

(56) References Cited

U.S. PATENT DOCUMENTS 4,602,662 A * 7/1986 Eremity et al. ..... 141/198
5,157,421 A * 10/1992 Kitahara ..... 347/86
5,381,172 A * 1/1995 Ujita et al. ..... 347/86
6,183,075 B1 * 2/2001 Sasaki ..... 347/86

* cited by examiner

*Primary Examiner*—Anh T. N. Vo
(74) *Attorney, Agent, or Firm*—Blakely Sokoloff Taylor & Zafman LLP

(57) ABSTRACT

An ink cartridge where, in a two part housing, there are two cannula or needle penetrable resiliently sealed ports, one port providing access to an ink supply in a collapsible reservoir defined by a blow moulded container fitted with a one way valve and the second port providing, as a waste ink recover zone, space sealed within the housing that will grow as the ink supply is drawn off in use and the ink supply reservoir collapses. Preferably the one way valve is from a dip tube in the reservoir.

3 Claims, 5 Drawing Sheets

INK TANK (INKJET INK CARTRIDGE)

TECHNICAL FIELD

The invention relates generally to an ink cartridge and related methods of manufacture or use and related assemblies or combinations.

BACKGROUND ART

As used herein the term "ink cartridge" includes a cartridge which of itself may incorporate or may be adapted to connect to inkjet printing apparatus or part thereof. The term also includes an ink cartridge, the sole function of which is, to refill a printer cartridge and therefore the term "ink cartridge", except where otherwise specified, is generic to both applications plus any other application of an ink cartridge.

FIG. 1 of the accompanying drawing illustrates a conventional ink cartridge 100 for an inkjet printer comprising two sections i.e. an ink supply section 110 containing an ink bag 111 and a waste ink recovery section 120 having absorbent material 121 to hold waste ink return from the printing process. Sections 110 and 120 are partitioned by an inner wall 101 forming separated housing chambers. The ink bag 112 in section 110 is coupled to an outlet port 113 and the absorbent material 121 is in contact with an inlet port 123 forming a close fluid communication circuit when inserted into the inkjet printer.

The problem encountered in connect ion with the two sections of ink cartridge 100 in FIG. 1 is that it is necessary to have a sufficiently large waste ink recovery section 110 to contain an absorbent material having a capability of recovering the entire volume of ink supply contained in the ink bag 111. This capability is provided to cover the unlikely event of its being required to recover all ink that could be dispensed from ink bag 111. This means the volume of waste ink recovery section 120 has to be substantially the same as the volume of ink supply section 110. As a result, the volume of the entire cartridge 100 is large in order to accommodate the entire ink supply volume in either section of the cartridge.

U.S. Pat. No. 5,157,421 addresses a reduction in the overall size of the ink cartridge. FIG. 2 illustrates the cartridge of this U.S. patent where the design of the ink cartridge 200 allows a smaller overall size. The ink cartridge 200 has ink supply means (in a form of an ink bag 210) and a waste ink recovery means for recovering waste ink, which are both housed within the same cartridge chamber 201. The waste ink recovery means has a waste ink bag 220 including a polymeric absorber 221 therein. The polymeric absorber 221 has great absorption capabilities with a volume requirement of about one-half to one-tenth of that compared to conventional absorbent material used in the conventional ink cartridge. Therefore, a smaller volume of polymer absorber 221 can be used in the waste ink bag 220. Further, in employing a single chamber 201 for both the ink bag 210 and the waste ink bag 220, the volume increase in the waste ink bag 220 upon recovery of waste ink can be offset by the volume decrease in the ink supply bag 210 in supplying ink to a printer jet printing mechanism. This enables a remarkable reduction in the size and volume of the ink cartridge as compared to the conventional ink cartridge.

The improved design of cartridge as in U.S. Pat. No. 5,157,421 may achieve overall small cartridge size, however, it is more difficult to manufacture and increases the cartridge cost. Particularly, the cartridge uses two ink bags:

one for supplying ink and one for recovering waste ink. There is the cost of the two ink bag rather than one. High capacity polymer absorbent material is also of higher cost as compared to conventional absorbent material. Further, the ink bag and waste recovery bag are made of multi-layer material such as nylon film, polyethylene film and thin metal film laminated together. This costly multi-layer laminated material is then sealed at all sides and welded to the inlet port 230 and outlet port 240 (commonly made of hard plastic e.g. high density polyethylene if the contact layer of the laminated material is polyethylene film) respectively using technology such as heat welding. Welding a laminated film material onto a bard plastic is both difficult and risky as the rejection rate for quality assure purposes is high if leakage between laminated film and hard plastic is to be avoided. Further, depending on the inkjet printer mechanism, some of the waste ink may be returned into the ink supply bag and can contaminate the unused ink in the ink cartridge.

The problems that exist in ink cartridge as illustrated in U.S. Pat. No. 5,157,421 translate into extremely high product cost.

A object of the present invention is to provide an ink cartridge wherein the size of the cartridge is reduced using less costly components and using simpler and less costly manufacturing processes.

A further or alternative object to provide an ink cartridge less likely to allow waste ink contamination of unused ink.

SUMMARY OF THE INVENTION

The ink cartridge of the present invention is of a kind having both an ink supply and recovery system. It will have application with printer cartridge filling apparatus as disclosed in the patent specification being filed simultaneously herewith.

In a first aspect the present invention consists in an ink cartridge comprising or including

- a housing defining an interior space and having two ports to that space,
- a collapsable reservoir containing ink positioned within the interior space within the housing and having its outlet ("ink supply outlet") at or adjacent one of said ports ("the ink supply port"),
- optionally, a one way valve at or adjacent said outlet to allow only ink egress from the reservoir,
- (whether forming part of the optional one way valve or distinct therefrom) a needle or cannula penetratable resilient seal sealing the optional one way valve and/or the ink supply outlet,
- optionally, a dip tube from said optional one way valve or said ink supply outlet, said dip tube having its inlet at or adjacent that internal periphery of the collapsible reservoir that will be lowermost when the ink cartridge is orientated to its in use condition, and
- a needle or cannula penetratable seal sealing the second part (the "waste ink recovery port") of the housing,
- wherein said housing about the collapsible reservoir, and more so as the reservoir collapses as ink is taken therefrom, defines an ink receiver capable progressively as the reservoir collapses of taking into the space outside of the collapsible reservoir but wholly within the housing at least substantially all of the ink content of the collapsible reservoir.

Preferably said housing is formed at least essentially from two moulded parts, a first moulded part being able to receive and locate at least the collapsible reservoir containing ink and any optional one way valve prior to assembly of the two moulded parts together.

Preferably a said one way valve and a dip tube is present.

Preferably an assembly of the collapsible reservoir containing ink, the one way valve and the dip tube has been located in one part of the housing prior to the other component of the housing being sealed thereto.

Preferably one or both of the seals is or are inserted in the polls after the otherwise sealing together of the components of the housing.

Preferably the collapsible reservoir containing ink is a blow moulded plastics container having a neck or a head at or adjacent the ink supply outlet, such neck or head being less disposed to collapse than much of the remainder of the collapsible reservoir.

Preferably the collapsible reservoir containing ink is of a kind having a body with the ink supply outlet offset from any central access of the body and where there is a truncation or chamfer of part of the reservoir periphery to improve uptake of ink by a said dip tube inlet from within the collapsible reservoir.

The ink cartridge of the present invention supply means in the form of thin wall plastic bottle housed in a cartridge, and, a waste recovery chamber in the same cartridge. Preferably the cartridge housing is of two moulded sealed together using any suitable jointing technology, such as ultrasonic welding, adhesion, etc.

The ink supply bottle preferably is blow moulded to a thin wall form from a preform or parison in low density polyethylene. The preform can have, if desired, only a momentary existence without ever having been cooled to ambient temperatures.

A blow moulded bottle is perhaps the most perfect means to store liquid material such as ink. Unlike the ink bag which is heat sealed at all sides thereby increasing the risk of leakage of ink, a blow moulded bottle, despite its low cost, has a homogeneous wall all round and allows only a small opening in the form of an injection moulded bottle neck that provides communication of ink in an out of the bottle. The homogeneous wall of the bottle means no leakage is possible the wall of the bottle is thin and relatively soft. In the event any ink is dispensed out of the bottle with a cannula through a properly seal bottle neck (e.g. seal with a bottle plug), the wall of the bottle collapses as the amount of ink dispensed out reduces the internal pressure in the bottle. The choice of the material and wall thickness of the bottle preferably enables it to filly collapse when ink is completely depleted.

Therefore, as the bottle is preferably housed in a welded together two moulded component housing, the collapse of the bottle wall translates into space for the waste ink in the same chamber. The peripherally welded cartridge includes a supply port and a waste ink return pore. The supply port and waste ink return port are each plug sealed with a rubber seal plug capable of being pierced to enable a fluid tight communication to and from both (i) the ink cartridge and the inkjet printer, printer cartridge or the like requiring ink.

In the ink cartridge the internal chamber of the cartridge housing is able to contain all the waste ink recovered. In the unlikely worst case scenario where all ink from the ink bottle is recovered into the waste ink recovery chamber, the bottle would have been fully collapsed and waste ink chamber space correspondingly increased to be able to fully contain the full amount of waste ink. Effectively, the size of the cartridge in this invention can be smaller has been conventional and preferably can be smaller than that of the cartridge illustrated in U.S. Pat. No. 5,157,421 as neither ink bag nor absorber material is needed in the cartridge.

It is a well known problem in the inkjet industries that the ink quality is very important in ensuring both good print functionality as well as printout quality. The waste ink may contain dirt particles and excessive air bubbles, both are, effectively, the biggest enemy to high quality inkjet printing. Therefore, preferably a one-way valve within the ink supply port allows ink to flow only in an outwards direction thereby precluding the possibility of waste ink flowing back into the ink bottle and contaminating the unused ink.

DETAILED DESCRIPTION OF THE INVENTION

Figure 1:
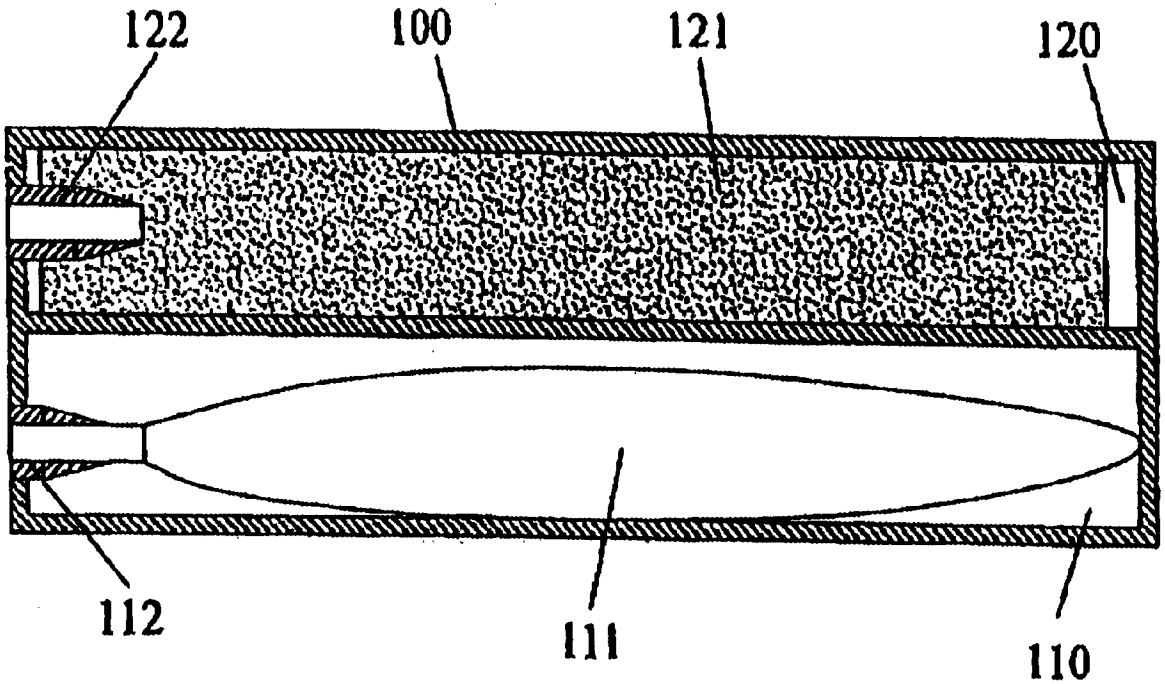
Fig. 1 (Prior Art)
FIG. 1 is a cross sectional illustration of a conventional ink cartridge known in the prior art.
Figure 2:
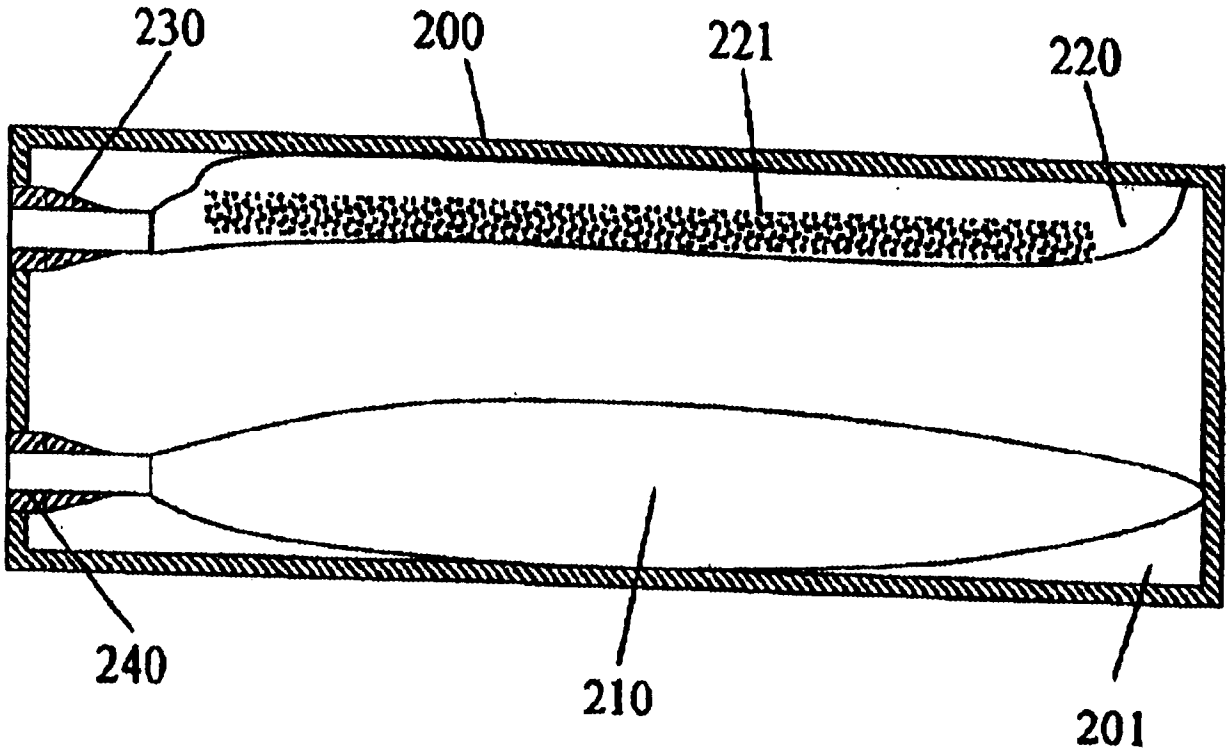
Fig. 2 (Prior Art)
FIG. 2 is a cross sectional illustration of an improved ink cartridge known in the prior art.
Figure 3:
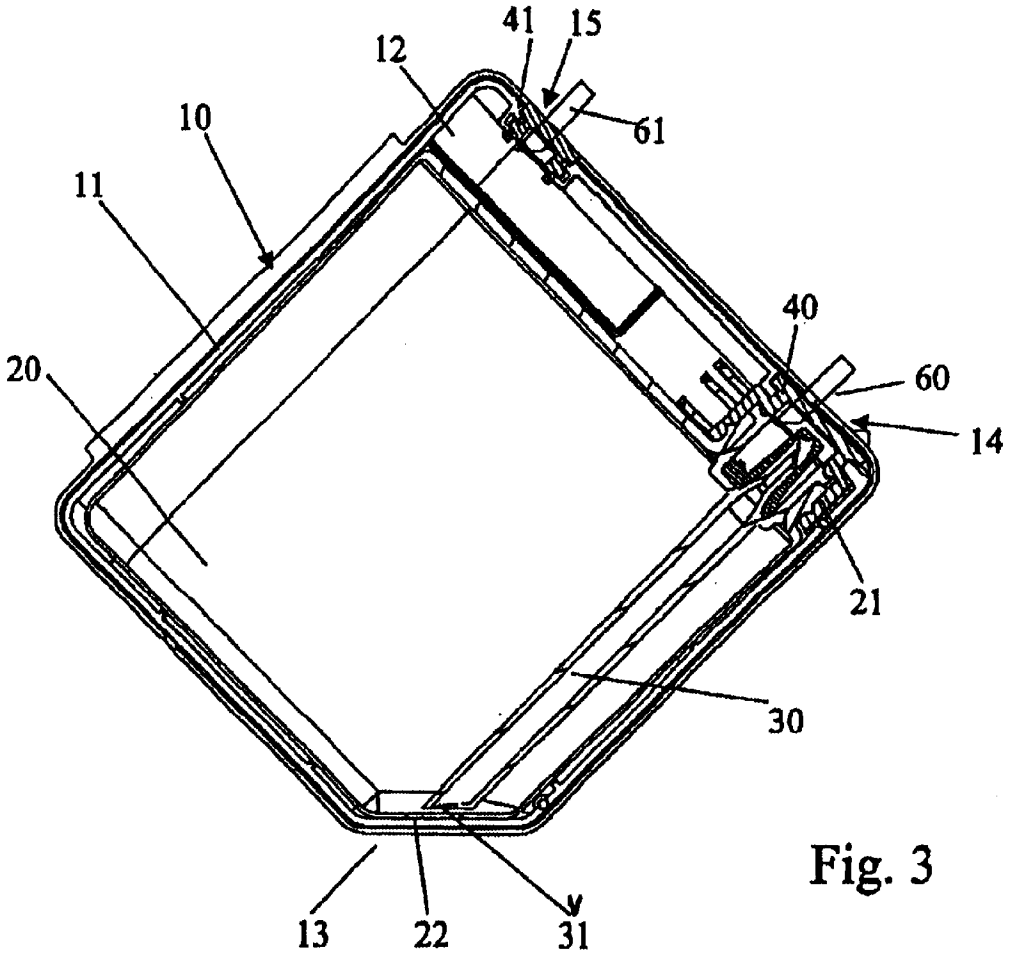
FIG. 3 is a cross sectional illustration of the ink cartridge of this invention.

Reference is now made to FIG. 3 wherein there is described the first embodiment of this invention.

Ink cartridge 10 has a housing component 11 closeable with a complementary housing component to define a single chamber 12 containing ink supply means (in the form of plastic ink bottle 20) and ink recovery means built-in in the same chamber 12 of cartridge 10.

The ink bottle 20 which contains ink has a plastic needle or tube (ie; dip tube) 30 that is assembled onto the offset bottle neck area. The plastic tube 30 allows ink to be dispensed out of the ink bottle and thus the cartridge effectively. A one-way valve 50 is associated with (eg; inserted onto) the bottle neck as well. A rubber seal plug 40 is plug on to the bottle neck 21 to seal up the bottle, preventing ink leakage and forming the supply port 14 of the ink cartridge.

The pre-assembled ink bottle assembly is then assembled onto one half of the ink cartridge housing 11 as shown. At the waste ink return port 15, another rubber seal plug 41 is plugged onto the ink cartridge housing 11.

The other half or complementary housing component of the ink cartridge housing is then closed and sealed using for example, ultrasonic welding.

In use the ink cartridge is associated by insertion into a device (whether or the inkjet printer itself or otherwise) so that two cannulas will penetrate through the rubber seal plugs 40 and 41 of both the supply port 14 and waste ink return port 15 respectively. Upon full penetration, the rubber seal plug 40 and 41 is capable of self-sealing on the penetrating cannula thus closing fluid communication between the cartridge 10 and the device (eg; printer cartridge that requires ink filling or the inkjet printer itself) that is using it. The device has normally a suction mechanism that draw ink from the supply port 14 and any waste ink resulted from the device is returned into the waste ink recovery chamber 12 through the waste ink return ink port 15.

The built in one-way valve 50 is able to ensure better print functionality and printout quality by restricting waste ink from contaminating the ink in the ink supply bottle of the ink cartridge.

The plastic ink bottle 20 is a thin wall bottle made by a blow moulding process. It is of a plastic material such as low density polyethylene or other similar flexible material. The bottle wall, being flexible with a careful choice of material and wall thickness, is capable of collapsing when ink is drawn out from the ink bottle 20. When the ink amount reduces in the ink bottle 20, as a result of being dispensed out by a suction mechanism from the device that is using it, the internal pressure will drop, thus causing the bottle wall to collapse.

Figure 4B:
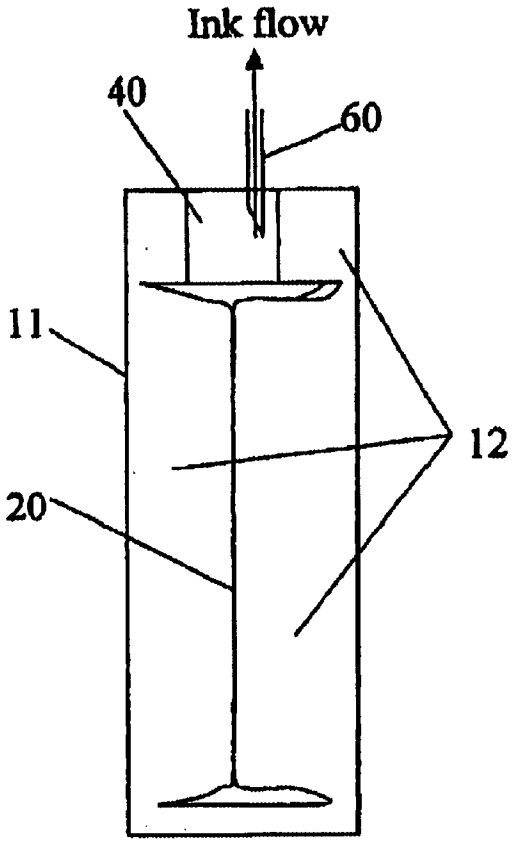
FIG. 4*a* and FIG. 4*b* are diagrammatic views illustrating the collapsible bottle used in the cartridge of FIG. 3.
Figure 4A:
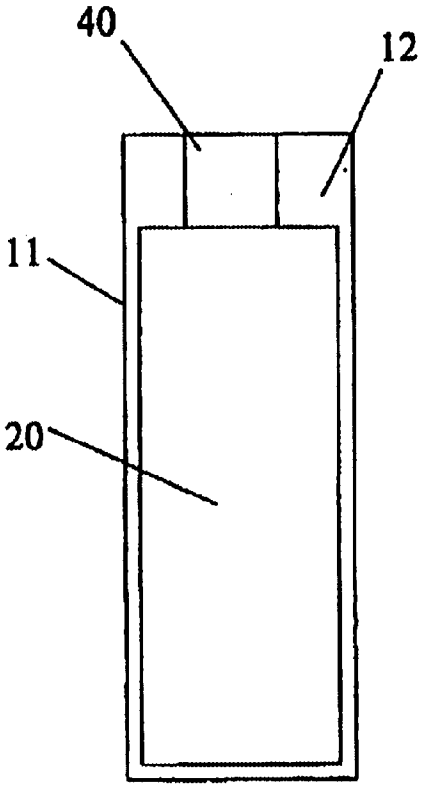

Now, reference is made to FIG. 4*a* and FIG. 4*b*. When the ink bottle 20 is full of ink, it occupies almost the entire volume of the ink cartridge 10, leaving a small amount of empty space to serve as waste ink recovery chamber 12. When ink is dispensed out through the cannula 60 that penetrates through the rubber seal plug 40, ink bottle 20 collapses. In the normal working scenario, where all the ink is being depleted and the majority of the ink is being used by the device, the ink bottle 20 will filly collapse as shown in FIG. 4*b*. Nevertheless some amount of ink will return to the waste ink recovery chamber 12 which is now increased in size due to the collapse of ink bottle 20. In the unlikely event of the worst case scenario where all ink supplied is returned as waste ink, the waste ink recovery chamber is also sufficient to contain all the waste ink within the now fully increased in space waste ink recovery chamber 12.

Reference is now back to FIG. 3.

As opposed to normal blow bottle where the bottle neck is normally at the center of the bottle body, ink bottle 20 preferably has a bottle neck 21 offset to one side of the bottle body. The body of the ink bottle preferably also has a chamfer or truncation 22 at the bottom corner on the same side as the bottle neck 21.

The ink cartridge housing 11 preferably has a corresponding chamfered or truncated corner 13.

The chamfers allows the ink cartridge 10 and thus the ink bottle 20 to be seated at an angle, at around 45°. The plastic needle 30 is also specifically designed to have a chamfered end 31 facing towards the chamfer 22 area of the ink bottle 20. The purpose of this arrangement is to reduce amount of unused ink as illustrated in FIG. 5*a* to FIG. 5*d*.

Before examining the amount of ink that will remain in the bottle (i.e. ink that is unable to be fully dispensed out), it is required to note that there needs to be sufficient clearance H between the end of the plastic needle 30 and the wall, specifically the chamfer area 22 of the ink bottle 20, for proper ink flow Too little clearance H is undesirable as it will slow down the ink flow rate.

Figure 5A:
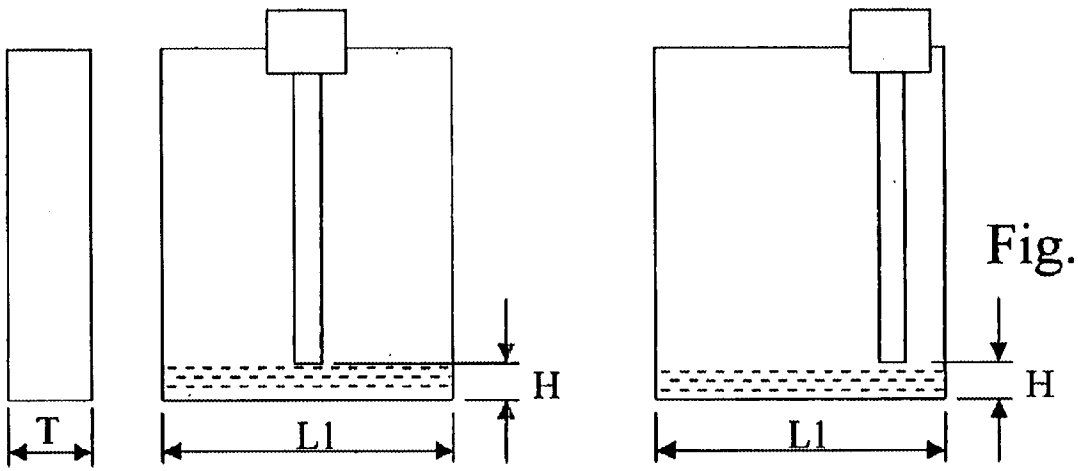
FIG. 5*a* to FIG. 5*d* are diagrammatic views illustrating various design considerations given to ensure a minimum amount of unused ink will be left in the ink cartridge in this invention.
Figure 5B:
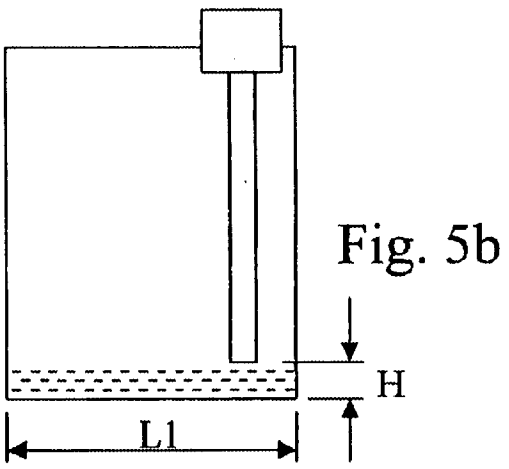
Figure 5C:
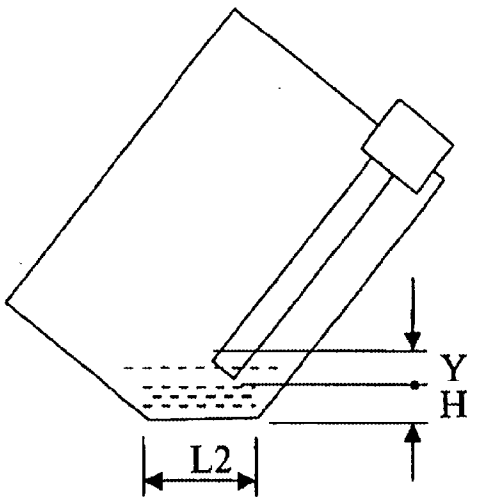
Figure 5D:
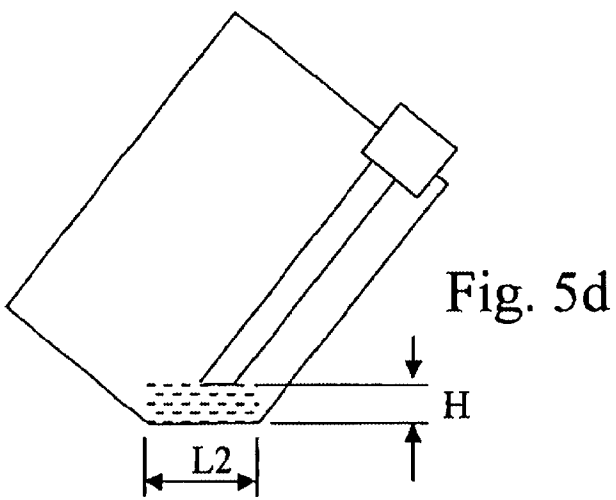

FIG. 5*a* and FIG. 5*b* show that if the plastic needle is either located at the center or one side of the bottle, but the bottle is made without a chamfer, the amount of unused ink is L1×H×T. In FIG. 5*c*, if the chamber if added to allow the cartridge to be seated in an angle, but the plastic needle has a flat end, the amount of ink left is approximately (L2)(H+Y)×T. FIG. 5*d* shows that if the chamber is added to allow the cartridge to be seated in an angle, and the end of the plastic needle is also chamfered to the same angle, the amount of unused ink is approximately L2×H×T. Since L1 is greater than L2 (L1>L2), the least amount of unused ink will result from the design as shown in FIG. 5*d* which is preferably employed in the design of the preferred embodiment of the present invention.

Thus, the invention described herein is capable of achieving smaller overall cartridge size and lower product cost.

What is claimed is:

1. An ink cartridge comprising or including a housing defining an interior space and having an ink support port with a dip tube and a waste ink recovery port to that space, a collapsible reservoir containing ink positioned within the interior space within the interior space within the housing, a needle or cannula penetratable resilient seal sealing the ink supply port and/or the outlet of the collapsible reservoir, a needle or cannula penetrable seal sealing the waste ink recovery port of the housing, wherein said housing about the collapsible reservoir, and more so as the reservoir collapses as ink is taken therefrom via the dip tube and the ink supply port, defines an ink receiver capable progressively as the reservoir collapses of taking into the space outside of the collapsible reservoir but wholly within the housing at least substantially all of the ink content of the collapsible reservoir, and wherein the collapsible reservoir has its outlet such as to restrict ink supply from the reservoir to the dip tube and the ink supply port, and wherein the dip tube has its inlet at or adjacent that internal periphery of the collapsible reservoir that will be lowermost when the ink cartridge is oriented to its use condition, and wherein the collapsible reservoir containing ink and the dip tube has been located in one part of the housing prior to the other part of the housing being sealed together, and wherein the collapsible reservoir containing ink is a blow moulded plastics container having a neck or a head at or adjacent the ink supply outlet, such neck or head being less disposed to collapse than much of the remainder of the collapsible reservoir, and wherein the collapsible reservoir containing ink is of a kind having a body with the ink supply outlet offset from any central axis, if any, of the body and where there is a truncation or chamfer of part of the reservoir periphery to improve uptake of ink by said dip tube inlet from within the collapsible reservoir.

2. A cartridge of claim 1 wherein said housing is formed at least essentially from two moulded parts, a first moulded part being able to receive and locate at least the collapsible reservoir containing ink, prior to assembly of the two moulded parts together.

3. An ink cartridge as claimed in claim 2 wherein one or both of the seals is or are inserted in the ports after the otherwise sealing together of the parts of the housing.

* * * * *